US005194120A

United States Patent [19]

Peats et al.

[11] Patent Number: 5,194,120

[45] Date of Patent: Mar. 16, 1993

[54] PRODUCTION OF PAPER AND PAPER PRODUCTS

[75] Inventors: Stephen Peats, Camden; Harris J. Bixler, Belfast, both of Me.

[73] Assignee: Delta Chemicals, Searsport, Me.

[21] Appl. No.: 947,082

[22] Filed: Sep. 18, 1992

Related U.S. Application Data

[63] Continuation of Ser. No. 701,152, May 17, 1991, abandoned.

[51] Int. Cl.[5] ..... D21H 17/45

[52] U.S. Cl. ..... 162/168.3; 162/175; 162/181.6; 162/183

[58] Field of Search ..... 162/168.3, 181.6, 181.8, 162/183, 175, 164.6

[56] References Cited

U.S. PATENT DOCUMENTS

| | | | |
|---|---|---|---|
| 2,924,549 | 2/1960 | Klein et al. | 162/181.6 |
| 3,694,202 | 9/1972 | Sawyer et al. | 162/181.6 |
| 4,889,594 | 12/1989 | Gavelin | 162/183 |
| 4,913,775 | 4/1990 | Langley et al. | 162/181.8 |
| 4,925,530 | 5/1990 | Sinclair et al. | 162/164.6 |
| 4,927,498 | 5/1990 | Rushmere | 162/168.3 |
| 4,946,557 | 8/1990 | Svending | 162/168.3 |
| 4,964,954 | 10/1990 | Johansson | 162/181.6 |
| 4,980,025 | 12/1990 | Andersson et al. | 162/181.6 |

FOREIGN PATENT DOCUMENTS

| | | | |
|---|---|---|---|
| 0277728 | 8/1988 | European Pat. Off. . | |
| WO/8912661 | 12/1989 | PCT Int'l Appl. . | |
| 8605826 | 10/1986 | World Int. Prop. O. | 162/181.6 |

*Primary Examiner*—Peter Chin
*Attorney, Agent, or Firm*—Kenyon & Kenyon

[57] ABSTRACT

Processes for making paper are disclosed wherein a cationic polymer and an amorphous metal silicate material are added to a paper furnish prior to introduction of the furnish to the headbox of a paper making apparatus.

9 Claims, No Drawings

PRODUCTION OF PAPER AND PAPER PRODUCTS

This application is a continuation of application Ser. No. 07/701,152, filed May 17, 1991 now abandoned.

FIELD OF THE INVENTION

This disclosure relates to methods for increasing retention, drainage, formation and other qualities during the production of paper from pulp slurries.

BACKGROUND OF THE INVENTION

Process improvements to maximize retention, drainage, formation, and drying are continually being demanded. The introduction of closed loops have increased the complexity in these paper making systems. The desire to maximize all operating parameters simultaneously and the properties of the paper being made, via chemical additives, has proved troublesome.

Currently, many paper makers attempt to maximize filler and pulp fines retention by the addition of a high molecular weight, water soluble polymer, such as derivatized polyacrylamide. The derivatized polyacrylamide used may be cationic or anionic in nature. In general, it has been found that the higher the molecular weight of the material used, the greater has been the retention. On the other hand, as the molecular weight of the polyacrylamide is increased, sheet formation decreases. The same is true for increasing the amount of polyacrylamide used, namely retention increases, but sheet formation suffers.

Britt (Tappi (1980) 63, 5, 105–108) recognized that if fibrous flocs formed as a result of the addition of polymer are such that they are serious and undesirable, then overflocculation has occurred. Britt also noted, however, that whether a given type or amount of polymer results in overflocculation greatly depends upon the turbulence prevailing during and after the addition of the polymer. Pummer (Papier (1973) 27, 10417–422) had previously shown that polyacrylamides caused excessive agglomeration of the fines particles and thus lowered the optical qualities of the paper.

The understanding of the interrelationship between energy (such as turbulence or shear) to which the stock is subjected prior to sheet formation, as well as where the necessary additives are introduced, became the focus of increased attention. Luner and Keitaaniemi (Tappi Paper Makers Conference, (1984) 95–106) noted that for the polyacrylamide tested, first-pass retention increases, reaches a maximum, and then declines with increasing energy input.

Stratton (Tappi (1983) March 141–144) drew a similar conclusion and stated that a compromise is necessary because the polymer must be distributed uniformly prior to adsorption, but once adsorbed it is important to avoid extreme turbulence. The compromise suggested by Stratton was to introduce the polymer at the outlet of a high-shear element (e.g. fan pump or pressure screen) where turbulence is still adequate for polymer distribution but not so extreme as to reduce retention.

A series of papers addressed the subject of the shear associated with the various elements in the paper making process and their effect on retention systems. van de Ven and Mason (Tappi (1981) 64, 9, 171–175) concluded that the forces that predominate are the hydrodynamic forces rather than the colloidal forces.

Tam Doo et.al, (J. Pulp and paper Science (1983) July, J80–J88) estimated the fluid shear rates and maximum shear stress on fiber walls for various components of the paper making system and compared these values against those obtained on a standard piece of laboratory equipment (namely a Dynamic Drainage Jar). This comparison allowed a more realistic assessment of polymeric retention systems, with respect to simulating both type of polymer and point of addition.

The relationship between shear and retention was further investigated by Hubbe (Tappi (1986) August 116–117) who came to the conclusion, somewhat at odds with the teachings of Britt, Stratton and Mason, that polyacrylamide should be added prior to the fan pump to assure efficient mixing. Waech (Tappi Engineering Conference (1982); Tappi (1983), March 137–139), concurred with Hubbe and showed that the addition of the polymer ahead of the fan pump, when compared with the polymer added after the fan pump, gave similar retention and improved formation. These experiments were performed on a system in which all the filler was added after the polymer, a somewhat unrealistic model for actual paper making.

Booth (U.S. Pat. No. 2,368,635) was the first to utilize bentonite as a retention aid, proposing that the bentonite acted as both a coagulant of finely divided particles and an absorber of contaminating substances.

Pye (U.S. Pat. No. 3,052,595) utilized a combination of bentonite and anionic or neutral polyacrylamide to achieve much lower turbidity in the white water of a laboratory scale paper making device. The preferred method of addition was to add the bentonite prior to the polyacrylamide.

The use of bentonite was also investigated by Pummer (DE Patent 2262906) who claimed that the addition of aluminum sulphate and bentonite to the stock prior to the addition of polyethyleneimines, polyamide-polyamines or polyetheamines increased the performance of the polymers.

Auhorn (Wochenblatt Fur Papierfabrikation (1979) 13,493–502) also utilized bentonite as an additive, prior to the addition of polyethyleneimine, to reduce the amount of oxidizable substances in the paper and also to increase the effect of the polyethyleneimine that was subsequently added to the paper making stock.

Auhorn in later work (Wet End Paper Technology Symposium (1981) March, Munich), enlarged on his earlier work to include both polyethyleneimine and polyacrylamide. The conclusions on a lab scale were similar to the earlier work, although these improvements were never fully realized on a paper making machine trial.

Langley and Litchfield (U.S. Pat. No. 4,305,781) proposed a similar system utilizing a bentonite clay and a largely non-ionic, high molecular weight polymer to be used on cellulosic suspensions substantially free of filter. It is suggested that the bentonite is added to thick stock, to the hydropulper or to the re-circulating white-water. The polymer is ideally added after the last point of high shear, typically after the centri-screens and just before the head-box.

Bentonite-polymer systems were not and are not the only example of what are known as "multi-component or microparticulate retention systems."

As early as 1975 Arledter (Papier 29, 10a, 32–43) used a combination of polyethylene oxide and melamine formaldehyde resin to improve retention. Addition of the polyethylene oxide at either the machine chest or headbox gave comparable retentions.

Svending (U.S. Pat. No. 4,385,961 and U.S. Pat. No. 4,388,150) described a retention system that, to some extent, gave both increased retention and drainage without a concomitant decrease in formation. This retention system is comprised of cationic potato starch and a colloidal silicic acid. Little mention is made of where these addition points are relative to the various points of shear except that starch should be added to, and well mixed with, the stock prior to addition of the silica for the best results. This system has been marketed under the name Composil by ProComp, a joint venture of EKA and duPont, Marietta, GA. However, the usefulness of the system is limited because it is much less effective in an acid paper making system, and it is an expensive system because both the starch and silica costs are quite high, and significant amounts of both are required.

Anderson in W086/05826 describes modification of the surface of silica with aluminum ions to produce a colloidal silica particle that maintained its efficiency over the whole pH range utilized by paper makers, namely pH 4–8. This aluminum modified silicic acid solution was used in combination with a cationic polyacrylamide. Many examples of drainage and retention improvements are given using standard laboratory practices. In all examples given, the polymer was added prior to the aluminum modified silicic acid solution.

Two publications related to the improvement in sizing of paper (Finnish patents 67735 and 67736) used a combination of a cationic polymer retention agent including polyacrylamide, polyethyleneimine, polyamine, polyamideamine or melamine formaldehyde polymer and an anionic polymeric binding agent including colloidal silicic acid, bentonite, carboxymethylcellulose or anionic polyacrylamide. Although these papers focus on the effect on sizing, it is recognized that the retention of filler and fine particles also improves.

Finnish Patents 67735 and 67736 espouse the use of similar chemical additives, the difference being that in 67735 the size is applied to the already formed sheet of paper and in 67736 the size is applied to the water suspension prior to the formation of the sheet of paper. However, the definition of the retention mixture and method of application remain unchanged between the patents. Patent 67735 claims the cationic compounds can be present between 0.2 and 40 lbs./ton and the anionic compounds can be present between 0.2 and 12 lbs./ton.

Lorz (U.S. Pat. No. 4,749,444) suggests that procedures outlined by Langley in U.S. Pat. No. 4,305,781 and European Patent 0017353 and by Pye (U.S. Pat. No. 3,052,595) both suffer from the same defect, namely, over flocculation of the sheet. Lorz outlines a method of adding "bentonite" to the thick stock (consistency 2.5 to 5.0% by weight), followed by agitation and dilution to a thin stock (consistency 0.3 to 2% by weight), followed by addition of a cationic polyelectrolyte and, after thorough mixing, a high molecular weight (1 million to 20 million average molecular weight) anionic or cationically charged polymer is added. Although this process results in improved drainage, no values are given for formation. The examples given are filler-free stock suspensions.

This work by Lorz was an extension of the coagulation-flocculation theory that is now generally accepted. The residual charge on the furnish, as measured by a cationic demand, zeta potential, mobility or colloid titration procedure, should be close to zero to maximize the coagulation process. Effective coagulation results in small, very shear-sensitive, agglomerates but these small agglomerates can be flocculated by the use of high molecular weight polymers. This flocculation is often achieved by the use of cationic polyelectrolytes as described by Lorz. This results in acceptable flocculation parameters, and minimizes the use of the high molecular weight polymer, while maintaining sufficient retention and drainage.

Langley (Tappi (1986) Paper makers Conference) outlined another system utilizing a combination of bentonite and polyacrylamide, where an excess of high molecular weight linear synthetic cationic polymer is added to an aqueous cellulosic suspension before shearing the suspension, and adding bentonite after shearing and then draining the purified suspension. This system is an expensive system because (1) five times as much high molecular weight polymer was used in comparison with conventional polymeric retention aid use levels, and (2) there was the additional expense of the bentonite.

European application 0 373 306 discloses a retention aid composition comprising a water dispersible colloidal siliceous material in intimate association with a low molecular weight, water soluble, high charge density organic polymer, such as a polyacrylic acid or a polyamine, the ionicity of the siliceous material being significantly modified by the charge on the polymer. The composition is produced by reacting the siliceous material and the organic polymer in an aqueous phase system. The composition is said to be suitable for use as a retention/drainage agent in paper production, preferably after the addition of a conventional high molecular wieght flocculating agent.

SUMMARY OF THE INVENTION

To provide improved retention in a paper making process, the present invention utilizes colloidal metal silicate materials that are synthetic (i.e., not naturally occurring) and largely amorphous. The synthetic route allows the control of the properties of the product so as to maximize its effectiveness.

These amorphous metal silicates materials can be produced in a pure form, free of extraneous or contaminating material, and can be produced as a white free-flowing powder. These materials form extremely small particles when fully dispersed in water and, once dispersed, form a clear colloidal dispersion of anionic particles. The magnitude of this anionic charge is largely independent of pH in the range 4–9.

These unique properties make it superior to other products. Colloidal silicic acid preferred in similar applications can only be made as a 15% dispersion. It can never be made dry, and has an anionic charge that is pH dependent. Bentonites in the dry form are brown to tan in color and form dispersions that are opaque and light brown to tan in color. This color reduces the brightness of the paper produced when bentonite is used.

Improved production of paper and paper proucts is achieved in accordance with the present invention by adding a cationic polymer and the amorphous metal silicate separately to the furnish with sufficient mixing between additions. The order of addition of these components is not critical, although addition of the polymer prior to the last high shear element and subsequent addition of the amorphous metal silicate before feeding the resultant mixture to a headbox of a paper making machine, without subjecting such mixture to any further substantial shear, is the preferred method.

This combination of ingredients has several advantages, including providing improved retention, drainage and formation while minimizing the amount of polymer and amorphous metal silicate necessary, resulting in reduction of the total cost of the binder composition.

DETAILED DESCRIPTION

In crystalline metal silicates, metal ions and silicate ions of uniform size and shape are arranged in a regular manner in a solid lattice. However, most solutions of soluble silicates do not contain silicate ions of uniform size, but, instead, a mixture of polysilicate ions. Thus, when polysilicate ions combine with metal ions, the resulting insoluble precipitate is almost always amorphous. In contrast, naturally-occurring silicates are almost always crystalline and highly-structured in nature due to the conditions under which they are formed.

In order for amorphous metal silicates to possess a cation exchange capacity, or anionic charge, it is necessary for a minor portion of the predominant metal cation to be substituted by a cation of lower valency. For example, this can be conveniently achieved by substituting $Mg^{2+}$ for the predominant $Al^{3+}$, or $Li^{+}$ for the predominant $Mg^{2+}$. This charge deficiency is balanced by a cation outside, but associated with, the amorpohous structure, and is referred to as an exchangeable ion which in turn gives rise to the cation exchange capacity.

In synthesizing these amorphous metal silicates, it is then possible to control cation exchange capacity of the resulting product which extends further control to the properties of these materials. These amorphous materials are usually synthesized by reacting the appropriate metal ions with sodium silicate and then raising the pH by the addition of a suitable alkali solution. The resulting precipitate is then simply filtered, washed, and dried. The selection of metal silicates includes, but is not necessarily restricted to, aluminum, magnesium, and lithium. There can also be introduced into this system fluoride ions by the use of LiF or HF into the reaction mixture. These reactions are routinely carried out at temperatures in the range 95° C.–180° C. but temperatures as high as 300° C. can be used. The lower temperatures, namely, 95° C.–100° C. allow the reaction to be carried out at atmospheric pressure which permits the use of non-pressurized systems, these systems being less expensive to install and operate.

Some such amorpohous metal silicate materials are commercially available, including "Laponite" (available from Laporte Industries Ltd.) and "DAC 3" (available from Delta Chemicals).

Typically, these amorphous metal silicates are white free-flowing powders. However, they can also be provided as an aqueous suspension, typically at concentrations of from 1% to 20% by weight. These concentrated solutions must be further diluted to achieve a working concentration of approximately 0.1 to 0.15% by weight, prior to addition to the paper furnish, by addition of water followed by moderate agitation. The materials should be fully dispersible in water and the resultant colloidal dispersion should preferably possess a cation exchange capacity greater than 40 meg/g and a surface area greater than 200 $M^2/g$.

Cationic polymers useful in the present invention are typically those having a molecular weight as characterized by intrinsic viscosity in the range of 5 to 25 dl/g and having a charge density of from 0.01 to 5 equivalents of cationic nitrogen per kg (0.1% to 50% mole substitution) as measured by polyelectrolyte titration. Such polymers include, in addition to the quaternized Mannich polyacrylamides, polymers such as tertiary amine Mannich polyacrylamides, quaternized and unquaternized copolymers of dimethylamino ethyl (or methyl) acrylate and acrylamide, polyethleneimines, dimethylamine-epichlorohydrin polymers, polyadmidoamines, and homo- and co-polymers (with acrylamide) of diallyldimethylammonium chloride. Tertiary amine and quaternary amine derivatives of linear polyacrylamides having intrinsic viscosities in the range 6 to 18 dl/g and with charge densities in the range of 0.5 to 3.5 equivalents cationic nitrogen per kg polymer are preferred in practicing the present invention.

The polymer and the amorphous metal silicate material are typically employed in weight ratios of from 0.03 to 30:1, preferably in the range 0.5 to 4:1. Typically, amorphous metal silicate will be added in amounts to produce a concentration of amorphous metal silicate in the paper stock in the range 0.2 to 6 lbs/ton dry base sheet, preferably in the range 0.5 to 4 lbs/ton dry base sheet. The polymer will typically be added in amounts to produce a concentration of 0.5 to 4, preferably 0.6 to 2.5, lbs/ton of dry base sheet.

The methods of the present invention may be used in paper making as a drainage aid in the absence of a filler. These methods will also frequently be employed in conjunction with fillers (and pigments), such as kaolin, calcium carbonate, talc, titanium dioxide, barium sulfate, bentonite or calcium sulfate in which case it will act as both a drainage aid and binder for the filler. The method of the present invention will also frequently be employed in conjunction with sizing agents, colorants, optical brighteners and other minor ingredients of commercial paper-making furnishes. The retention aids continue to perform its intended purpose in the presence of the additives.

A charge-bearing starch (e.g., from 1 to 30, preferably 2 to 10, lbs/ton of furnish) may also be present as a wet or dry strength additive. That is, amounts that result in a weight ratio of starch to amorphous metal silicate of 0.25 to 150:1, preferably 0.5 to 8:1, may be employed. Such starch is conveniently a cationic starch having a degree of substitution above 0.03 (0.15 equivalents of nitrogen per kg starch). Alternatively, however, an amphoteric starch may be used. Particularly useful starches are potato starch, waxy maize starch, corn starch, wheat starch and rice starch.

Starch is usually added early in the system, typically to the machine chest, to allow it time to react with the various ingredients of the paper furnish. This system simply requires that starch, if used, be added and sufficiently mixed prior to the addition of the polymer and the amorphous metal silicate. The addition of the amorphous metal silicate and the polymer can be made in either order and at any position as long as the other ingredients in the furnish have been added and well mixed.

The starch-polymer-amorphous metal silicate complex should, however, once formed, not be subjected to excessive shear forces. A convenient way of achieving this is to add the starch at the machine chest, the polymer prior to the last point of high shear, and the amorphous metal silicate subsequent to the last point of high shear. This allows the starch sufficient time to react, the polymer to be sufficiently well mixed, and the resulting starch-polymer-amorphous metal silicate to be subjected to the minimum amount of shear.

The methods of the present invention can be used with a variety of paper making furnishes including those based on chemical, thermomechanical and mechanical treated pulps from both hard and softwood sources.

The present invention will be further described in the following examples, which show various application methods, but are not intended to limit the invention prescribed by the appended claims.

EXAMPLE 1

An acid paper furnish containing ground wood was obtained from an operating paper mill having a headbox consistency of 0.46%, a pH of 4.51, a conductivity of 610 $\mu$mho.cm$^{-1}$, and an alum concentration of 160 ppm.

A commercial cationic polyacrylamide retention aid (216A) of medium molecular weight and low charge density and a commercial cationic potato starch from Penford Products (Astro X-101) with medium charge density were used for these tests. The polymer was made up at 0.05% and the starch at 1.0% and were prepared by techniques recommended by the manufactures. DAC 3, amorphous metal silicate, available from Delta Chemicals, Searsport, Me. and used as a 0.15% aqueous colloidal suspension, was also used in these tests.

Mixing of starch, polymer and colloid with the furnish was carried out in a Britt Dynamic Drainage Jar. The starch was added to the Britt Jar when the stirring speed was 1000 rpm and was maintained at this speed for 30 seconds. Next the polymer was added while the speed was still at 1000 rpm. This speed was maintained for 10 seconds after the addition of the polymer, then the speed was increased to 2000 rpm for 10 seconds. The speed was then reduced to 1000 rpm and the colloid was added. This speed was maintained for an additional 10 seconds after which a drainage sample was collected, filtered and dried. This procedure simulated polymer addition before a high shear device such as a fan pump and colloid addition after the last point of high shear in the wet end of a paper machine.

Drainage rates were also determined by transferring the furnish as described and prepared above to a drainage tube. The time to drain a set volume was then determined; and, from this a drainage rate was calculated. Results are shown in Table I.

TABLE I

| STARCH | | POLYMER | | COLLOID | | FINES | DRAINAGE |
|---|---|---|---|---|---|---|---|
| TYPE | CONC (#/T) | TYPE | CONC (#/T) | TYPE | CONC (#/T) | RETENTION (%) | RATE (mis/sec) |
| PF X 101 | 20 | | | | | 27.3 | 1.16 |
| PF X 101 | 20 | 216A | 1 | | | 45.7 | 1.74 |
| PF X 101 | 20 | 216A | 1 | DAC 3 | 1 | 47.9 | 2.17 |
| PF X 101 | 20 | 216A | 1 | DAC 3 | 2 | 52.1 | 2.43 |
| PF X 101 | 20 | 216A | 1 | DAC 3 | 4 | 64.0 | 3.70 |

These data demonstrate that DAC 3 in the presence of starch and polymer shows a distinct performance improvement in both fines retention and drainage rate when compared to polymer and starch alone.

EXAMPLE 2

An acid paper furnish containing ground wood was obtained from an operating paper mill. The headbox consistency of the furnish was 0.43%, the pH was 4.51 and the conductivity was 670 $\mu$mho.cm$^{-1}$.

A method similar to that of Example 1 was used. These experiments were conducted in the absence of any additional starch. The cationic polymer used was CD31HL (available from Allied Colloids, Limited, Bradford, England) and is a medium molecular weight polyacrylamide with moderate cationic charge. This material is supplied as a 50% dispersion. 2D5, also supplied by Allied Colloids, is a modified white pigment, a bentonite, and is supplied as a dry powder. The polymer was made at a concentration of 0.05% and the 2D5 and DAC 3 at a concentration of 0.14% for these experiments. The components were mixed as described in Example 1, with the exception that no starch was added and the subsequent 30 seconds of mixing at 1000 rpm were omitted. Results are summarized in Table II

TABLE II

| POLYMER | | COLLOID | | FINES |
|---|---|---|---|---|
| TYPE | CONC (#/T) | TYPE | CONC (#/T) | RETENTION (%) |
| | | | | 22.5 |
| CD31HL | 0.5 | | | 27.8 |
| CD31HL | 1.0 | | | 30.1 |
| CD31HL | 2.0 | | | 33.1 |
| CD31HL | 2.0 | 2D5 | 0.5 | 42.5 |
| CD31HL | 2.0 | 2D5 | 1.0 | 48.4 |
| CD31HL | 2.0 | 2D5 | 2.0 | 59.5 |
| CD31HL | 2.0 | 2D5 | 4.0 | 72.5 |
| CD31HL | 2.0 | DAC 3 | 0.5 | 48.7 |
| CD31HL | 2.0 | DAC 3 | 1.0 | 60.9 |
| CD31HL | 2.0 | DAC 3 | 2.0 | 67.9 |
| CD31HL | 2.0 | DAC 3 | 4.0 | 65.9 |

On the basis of these results, DAC 3 shows a strong interaction in the presence of polymer. The performance, when compared to 2D5, shows DAC 3 to give a significantly better response, particularly at the lower levels. It also demonstrates that DAC 3 can give a performance advantage if starch is absent.

EXAMPLE 3

An acid paper furnish containing ground wood was obtained from an operating paper mill. The headbox consistency of the furnish was 0.40%, the conductivity was 628 $\mu$mho.cm$^{-1}$ and the pH was 4.00.

A technique similar to that outlined in Example 1 was utilized. The polyacrylamide used was 4240A, supplied by Delta Chemicals, which is a high molecular weight, high cationic charge polyacrylamide and was employed at a concentration of 0.05%. The starch used was Sta-Lok 400 (Staley Manufacturing Company, Decatur, Ill.), a cationic potato starch with a high degree of substitution. The starch was used as a 1% solution for these experiments. Three different colloids were used: DAC3 and 2D5 as previously described, and the third was a colloidal silicic acid solution sold as BMA by Procomp, Marietta, Ga. BMA is sold as a 15% dispersion, but was used, as were the other two colloids, at a concentration of 0.14% for the experiments. The components were mixed as described in Example 1. Results are summarized in Table III.

TABLE III

| STARCH | | POLYMER | | COLLOID | | FINES | DRAINAGE |
|---|---|---|---|---|---|---|---|
| TYPE | CONC (#/T) | TYPE | CONC (#/T) | TYPE | CONC (#/T) | RETENTION (%) | RATE (MLS/SEC) |
| STA-LOK 400 | 20 | | | | | 40.5 | 2.38 |
| STA-LOK 400 | 20 | 4240A | 0.5 | | | 45.2 | 2.24 |
| STA-LOK 400 | 20 | 4240A | 1.0 | | | 50.3 | 2.42 |
| STA-LOK 400 | 20 | 4240A | 2.0 | | | 50.4 | 2.68 |
| STA-LOK 400 | 20 | 4240A | 4.0 | | | 53.4 | 2.54 |
| STA-LOK 400 | 20 | 4240A | 2.0 | SILICIC ACID | 0.5 | 55.1 | 3.41 |
| STA-LOK 400 | 20 | 4240A | 2.0 | SILICIC ACID | 1.0 | 56.8 | 2.94 |
| STA-LOK 400 | 20 | 4240A | 2.0 | SILICIC ACID | 2.0 | 56.1 | 3.33 |
| STA-LOK 400 | 20 | 4240A | 2.0 | SILICIC ACID | 4.0 | 57.8 | 3.75 |
| STA-LOK 400 | 20 | 4240A | 2.0 | DAC 3 | 0.5 | 54.0 | 3.33 |
| STA-LOK 400 | 20 | 4240A | 2.0 | DAC 3 | 1.0 | 57.8 | 3.75 |
| STA-LOK 400 | 20 | 4240A | 2.0 | DAC 3 | 2.0 | 58.9 | 3.85 |
| STA-LOK 400 | 20 | 4240A | 2.0 | DAC 3 | 4.0 | 69.9 | 4.41 |
| STA-LOK 400 | 20 | 4240A | 2.0 | 2D5 | 0.5 | 50.9 | |
| STA-LOK 400 | 20 | 4240A | 2.0 | 2D5 | 1.0 | 51.7 | |
| STA-LOK 400 | 20 | 4240A | 2.0 | 2D5 | 2.0 | 49.7 | |
| STA-LOK 400 | 20 | 4240A | 2.0 | 2D5 | 4.0 | 50.1 | |

These data indicate that DAC 3 proved to be superior to both 2D5 and silicic acid. 2D5 showed a minimal response in terms of fines retention and was consequently not tested for drainage.

EXAMPLE 4

An acid paper furnish containing ground wood was obtained from an operating mill. The headbox consistency of the furnish was 0.45%, the pH was 4.58 and the conductivity was 649 $\mu$mho.cm$^{-1}$. The polymer, colloids, and starch utilized were as described in Example 3. The component were mixed as described in Example 1. The results (summarized in Table IV) show that DAC 3 gives the strongest response in the presence of either polyacrylamide alone or polyacrylamide in combination with starch.

TABLE IV

| STARCH | | POLYMER | | COLLOID | | FINES |
|---|---|---|---|---|---|---|
| TYPE | CONC (#/T) | TYPE | CONC (#/T) | TYPE | CONC (#/T) | RETENTION (%) |
| | | | | | | 27.9 |
| STA-LOK 400 | 20 | | | | | 53.2 |
| STA-LOK 400 | 20 | 4240A | 1.0 | | | 60.4 |
| STA-LOK 400 | 20 | 4240A | 2.0 | | | 59.4 |
| STA-LOK 400 | 20 | 4240A | 4.0 | | | 59.7 |
| STA-LOK 400 | 20 | 4240A | 2.0 | DAC 3 | 1.0 | 66.5 |
| STA-LOK 400 | 20 | 4240A | 2.0 | DAC 3 | 2.0 | 73.2 |
| STA-LOK 400 | 20 | 4240A | 2.0 | DAC 3 | 3.0 | 80.0 |
| STA-LOK 400 | 20 | 4240A | 2.0 | 2D5 | 1.0 | 62.0 |
| STA-LOK 400 | 20 | 4240A | 2.0 | 2D5 | 2.0 | 61.5 |
| STA-LOK 400 | 20 | 4240A | 2.0 | 2D5 | 3.0 | 62.0 |
| STA-LOK 400 | 20 | 4240A | 2.0 | SILICIC ACID | 1.0 | 64.0 |
| STA-LOK 400 | 20 | 4240A | 2.0 | SILICIC ACID | 2.0 | 62.9 |
| STA-LOK 400 | 20 | 4240A | 2.0 | SILICIC ACID | 3.0 | 65.8 |
| | | 4240A | 2.0 | | | 49.7 |
| | | 4240A | 2.0 | DAC 3 | 1.0 | 58.0 |
| | | 4240A | 2.0 | DAC 3 | 2.0 | 62.1 |
| | | 4240A | 2.0 | DAC 3 | 3.0 | 62.0 |
| | | 4240A | 2.0 | 2D5 | 1.0 | 49.0 |
| | | 4240A | 2.0 | 2D5 | 2.0 | 58.7 |
| | | 4240A | 2.0 | 2D5 | 3.0 | 60.8 |
| | | 4240A | 2.0 | SILICIC ACID | 1.0 | 49.9 |
| | | 4240A | 2.0 | SILICIC ACID | 2.0 | 52.8 |
| | | 4240A | 2.0 | SILICIC ACID | 3.0 | 53.4 |

EXAMPLE 5

An alkaline paper furnish that was ground wood free was obtained from an operating mill. The consistency was 0.76%, the pH was 7.88 and the conductivity was 507 $\mu$mho.cm$^{-1}$. This furnish was tested using procedures as outlined in Example 1. The polyacrylamide, starch, and colloids were as described in Example 3. Results are summarized in Table V.

TABLE V

| STARCH | | POLYMER | | COLLOID | | FINES |
|---|---|---|---|---|---|---|
| TYPE | CONC (#/T) | TYPE | CONC (#/T) | TYPE | CONC (#/T) | RETENTION (%) |
| STA-LOK 400 | 20 | | | | | 35.6 |
| STA-LOK 400 | 20 | 4240A | 2.0 | | | 52.9 |
| STA-LOK 400 | 20 | 4240A | 2.0 | DAC 3 | 0.5 | 60.6 |
| STA-LOK 400 | 20 | 4240A | 2.0 | DAC 3 | 1.0 | 64.1 |
| STA-LOK 400 | 20 | 4240A | 2.0 | DAC 3 | 2.0 | 68.5 |

TABLE V-continued

| STARCH | | POLYMER | | COLLOID | | FINES |
|---|---|---|---|---|---|---|
| TYPE | CONC (#/T) | TYPE | CONC (#/T) | TYPE | CONC (#/T) | RETENTION (%) |
| STA-LOK 400 | 20 | 4240A | 2.0 | DAC 3 | 3.0 | 74.3 |
| STA-LOK 400 | 20 | 4240A | 2.0 | 2D5 | 0.5 | 56.1 |
| STA-LOK 400 | 20 | 4240A | 2.0 | 2D5 | 1.0 | 57.5 |
| STA-LOK 400 | 20 | 4240A | 2.0 | 2D5 | 2.0 | 59.8 |
| STA-LOK 400 | 20 | 4240A | 2.0 | 2D5 | 3.0 | 64.3 |

These results show that DAC 3 works well in an alkaline furnish and that the performance advantage over 2D5 is maintained.

EXAMPLE 6

A machine trial was run using a cationic polyacrylamide and DAC 3. The cationic polyacrylamide was a medium molecular weight low charge density material (commercially available from Allied Colloids as Percol 292). DAC 3 is as described previously. The polyacrylamide was added prior to the fan pump and screens and the DAC 3 was added after the screens and just before the headbox. Previously, the machine was using no polyacrylamide as the addition of polyacrylamide alone offered no benefits. Results are summarized in Table VI.

TABLE VI

| | BEFORE TRIAL | DURING TRIAL |
|---|---|---|
| Polymer (#/T) | 0 | 2 |
| DAC 3 (#/T) | 0 | 2 |
| First Pass Retention (%) | 63.9 | 71.3 |
| Drainage Rate (mls/sec) | 0.42 | 1.69 |
| Steam Pressure (psi) (to press section) | 25 | 14 |
| Tear | 74 | 71 |
| Formation | 11.2 | 11.2 |

The use of polyacrylamide in conjunction with DAC 3 gave them increased first pass retention, faster drainage, and a reduction in steam usage in the press section. The properties of the final sheet of paper were not, however, adversely affected in any significant way.

What is claimed is:

1. A process for making paper from a furnish, said process comprising introducing said furnish to the headbox of a paper making apparatus, wherein a cationic polymer and an amorphous metal silicate material are added to said furnish prior to introducing said furnish to said headbox, wherein said furnish is not subjected to any substantial shearing after addition of said cationic polymer and said amorphous metal silicate material to said furnish, wherein the predominant cation of said amorphous metal silicate material is magnesium, wherein said amorphous metal silicate material is present in an amount of from about 0.2 to about 6 lbs./ton dry sheet, wherein said cationic polymer has an intrinsic viscosity of about 5 to about 25 dl/g and a charge density of from about 0.01 to about 5 equivalents of nitrogen per kg polymer, and wherein said cationic polymer and said amorphous metal silicate material are added in a weight ratio of from about 0.03:1 to about 30:1.

2. A process according to claim 1 wherein said cationic polymer is a tertiary or quaternary amine derivative of polyacrylamide.

3. A process according to claim 1 wherein said weight ratio is from about 0.5:1 to about 4:1.

4. A process according to claim 1 wherein said amorphous metal silicate material is present in an amount of from about 0.5 to about 4 lbs/ton dry base sheet.

5. A process according to claim 1 wherein filler is present in said furnish in an amount of from about 50 to about 300 lbs/ton dry base sheet.

6. A process according to claim 5 wherein said filler is selected from the group consisting of kaolin, calcium carbonate, talc, titanium dioxide, barium sulfate and calcium sulfate.

7. A process according to claim 1 wherein a charge starch is present in said furnish.

8. A process according to claim 7 wherein said charged starch is a cationic starch having a degree of substitution in excess of about 0.03.

9. A process according to claim 8 wherein said charge starch is an amphoteric starch.

* * * * *

UNITED STATES PATENT AND TRADEMARK OFFICE

CERTIFICATE OF CORRECTION

PATENT NO. : 5,194,120
DATED : March 16, 1993
INVENTOR(S) : Stephen Peats, et. al.

It is certified that error appears in the above-indentified patent and that said Letters Patent is hereby corrected as shown below:

Column 4, line 35 change "wieght" to --weight--.
Column 4, line 60, change "proucts" to --products--.
Column 6, line 38, change "its" to --their--.
Column 10, line 1, change "component" to --components--.
Column 12, line 41, change "charge" to --charged--.
Column 12, line 47, change "charge" to --charged--.
Column 2, line 39, change "polyetheamines" to --polyethylamines--.

Signed and Sealed this

Nineteenth Day of July, 1994

*Attest:*

Bruce Lehman

BRUCE LEHMAN

*Attesting Officer*

*Commissioner of Patents and Trademarks*